US007559815B2

(12) United States Patent
Okuyama et al.

(10) Patent No.: US 7,559,815 B2
(45) Date of Patent: Jul. 14, 2009

(54) REMOTE CONTROL DEVICE, REMOTE CONTROL DEVICE SIDE ECU AND WATERCRAFT

(75) Inventors: Takashi Okuyama, Shizuoka-ken (JP); Noriyoshi Ichikawa, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/688,127

(22) Filed: Mar. 19, 2007

(65) Prior Publication Data

US 2007/0232162 A1 Oct. 4, 2007

(30) Foreign Application Priority Data

Mar. 17, 2006 (JP) ..... 2006-074794

(51) Int. Cl.
*B63H 21/21* (2006.01)

(52) U.S. Cl. ..... 440/84; 114/144 RE; 701/21

(58) Field of Classification Search ..... 114/144 RE, 114/144 E, 146; 440/1, 84, 86, 87; 701/1, 701/2, 21, 29
See application file for complete search history.

(56) References Cited

U.S. PATENT DOCUMENTS

| | | | |
|---|---|---|---|
| 1,843,272 | A | 2/1932 | Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |
| 4,622,938 | A | 11/1986 | Wenstadt et al. |
| 4,646,696 | A | 3/1987 | Dogadko |
| 4,648,497 | A | 3/1987 | Prince |
| 4,708,669 | A | 11/1987 | Kanno et al. |
| 4,747,381 | A | 5/1988 | Baltz et al. |
| 4,755,156 | A | 7/1988 | Wagner |
| 4,788,955 | A | 12/1988 | Wood |
| 4,801,282 | A | 1/1989 | Ogawa |
| 4,805,396 | A | 2/1989 | Veerhusen et al. |
| 4,809,506 | A | 3/1989 | Lauritsen |

(Continued)

FOREIGN PATENT DOCUMENTS

| | | |
|---|---|---|
| JP | 03-061196 | 3/1991 |

(Continued)

OTHER PUBLICATIONS

Co-pending U.S. Appl. No. 11/688,818, filed Mar. 20, 2007.

(Continued)

*Primary Examiner*—Lars A Olson
(74) *Attorney, Agent, or Firm*—Keating & Bennett, LLP

(57) ABSTRACT

A remote control device for controlling a watercraft propulsion device of a watercraft having an engine that generates propulsive power can have a plurality of remote control device side ECUs. All of the plurality of remote control device side ECUs can have the same construction. Each remote control device side ECU can have an ECU discriminating terminal section, an ECU determining section configured to determine a role of the respective remote control device side ECU based upon a signal provided from the ECU discriminating terminal section, and an exclusive use section configured to operate based upon a signal provided from the ECU determining section to execute a function corresponding to the role that is specifically assigned.

22 Claims, 7 Drawing Sheets

U.S. PATENT DOCUMENTS 4,810,216 A 3/1989 Kawamura
4,822,307 A 4/1989 Kanno
4,836,809 A * 6/1989 Pelligrino ..... 440/2
4,843,914 A 7/1989 Korke
4,850,906 A 7/1989 Kanno et al.
4,858,585 A 8/1989 Remmers
4,898,045 A 2/1990 Baba
4,903,662 A 2/1990 Hirukawa
4,924,724 A 5/1990 Yoshimura
4,964,276 A 10/1990 Sturdy
4,973,274 A 11/1990 Hirukawa
5,004,962 A 4/1991 Fonss et al.
5,050,461 A 9/1991 Onoue
5,051,102 A 9/1991 Onoue
5,062,403 A 11/1991 Breckenfeld et al.
5,062,516 A 11/1991 Prince
5,065,723 A 11/1991 Broughton et al.
5,072,629 A 12/1991 Hirukawa
5,076,113 A 12/1991 Hayasaka
5,103,946 A 4/1992 Masters et al.
5,127,858 A 7/1992 Pelligrino et al.
5,157,956 A 10/1992 Isaji et al.
5,167,212 A 12/1992 Peter et al.
5,201,238 A 4/1993 Hayasaka
5,231,890 A 8/1993 Hayasaka
5,245,324 A 9/1993 Jonker et al.
5,273,016 A 12/1993 Gillespie et al.
5,318,466 A 6/1994 Nagafusa
5,325,082 A 6/1994 Rodriguez
5,349,644 A 9/1994 Massey
5,352,138 A 10/1994 Kanno
5,381,769 A 1/1995 Nishigaki et al.
5,408,230 A 4/1995 Okita
5,445,546 A 8/1995 Nakamura
5,481,261 A 1/1996 Kanno
5,492,493 A 2/1996 Ohkita
5,539,294 A 7/1996 Kobayashi
5,595,159 A 1/1997 Huber et al.
5,664,542 A 9/1997 Kanazawa et al.
5,687,694 A 11/1997 Kanno
5,692,931 A 12/1997 Kawai
5,730,105 A 3/1998 McGinnity
5,749,343 A 5/1998 Nichols et al.
5,771,860 A 6/1998 Bernardi
5,782,659 A 7/1998 Motose
5,827,150 A 10/1998 Mukumoto
5,839,928 A 11/1998 Nakayasu
5,899,191 A 5/1999 Rabbit et al.
5,904,604 A 5/1999 Suzuki
5,935,187 A 8/1999 Trsar et al.
6,015,319 A 1/2000 Tanaka
6,026,783 A 2/2000 Nestvall et al.
6,055,468 A 4/2000 Kaman et al.
6,058,349 A 5/2000 Kikori et al.
6,067,008 A 5/2000 Smith
6,067,009 A 5/2000 Hozuka et al.
6,073,509 A 6/2000 Salecker et al.
6,073,592 A 6/2000 Brown et al.
6,085,684 A 7/2000 Cotton
6,095,488 A 8/2000 Semeyn, Jr. et al.
6,098,591 A 8/2000 Iwata
6,102,755 A 8/2000 Hoshiba et al.
6,109,986 A 8/2000 Gaynor et al.
6,174,264 B1 1/2001 Noshiba
6,217,400 B1 4/2001 Natsume
6,217,480 B1 4/2001 Iwata
6,233,943 B1 5/2001 Beacom et al.
6,273,771 B1 8/2001 Buckley et al.
6,280,269 B1 8/2001 Gaynor
6,351,704 B1 2/2002 Koerner
6,370,454 B1 4/2002 Moore
6,377,879 B2 4/2002 Kanno
6,379,114 B1 4/2002 Schott et al.
6,382,122 B1 5/2002 Gaynor et al.
6,414,607 B1 7/2002 Gonring et al.
6,487,983 B1 12/2002 Jonsson
6,536,409 B1 3/2003 Takahashi et al.
6,554,660 B2 4/2003 Irish
6,587,765 B1 7/2003 Graham et al.
6,595,811 B2 7/2003 Dagenais
6,599,158 B2 7/2003 Shidara et al.
6,612,882 B2 9/2003 Shidara et al.
6,615,160 B1 9/2003 Quinnett
6,647,769 B1 11/2003 Fujino
6,658,960 B2 12/2003 Babin et al.
6,659,815 B2 12/2003 Motsenbocker
6,691,023 B2 2/2004 Fujino et al.
6,704,643 B1 3/2004 Suhre et al.
6,751,533 B2 6/2004 Graham et al.
6,859,692 B2 2/2005 Okuyama
6,910,927 B2 6/2005 Kanno
6,965,817 B2 11/2005 Graham et al.
7,108,570 B2 9/2006 Okuyama
7,121,908 B2 10/2006 Okuyama
7,130,723 B2 10/2006 Minowa
7,142,955 B1 11/2006 Kern et al.
7,153,174 B2 12/2006 Takeda et al.
7,166,003 B2 1/2007 Motose
7,220,153 B2 5/2007 Okuyama
7,353,095 B2 4/2008 Kanno
2001/0049579 A1 12/2001 Fujino et al.
2003/0060946 A1 3/2003 Okuyama et al.
2003/0060952 A1 3/2003 Kanno et al.
2003/0061076 A1 3/2003 Okuyama et al.
2003/0082962 A1 5/2003 Kanno
2003/0092331 A1* 5/2003 Okuyama ..... 440/84
2003/0093196 A1 5/2003 Okuyama
2004/0029461 A1 2/2004 Shomura
2005/0085141 A1 4/2005 Motose
2005/0118895 A1 6/2005 Kanno et al.
2005/0118896 A1 6/2005 Okuyama et al.
2005/0245145 A1* 11/2005 Takada et al. ..... 440/1
2005/0286539 A1 12/2005 Okuyama
2006/0240720 A1 10/2006 Yamashita et al.
2007/0082565 A1 4/2007 Okuyama
2007/0082566 A1 4/2007 Okuyama
2007/0178780 A1 8/2007 Ito et al.
2007/0218785 A1 9/2007 Okuyama et al.
2007/0227429 A1 10/2007 Okuyama et al.

FOREIGN PATENT DOCUMENTS

JP 07-133733 5/1995
JP 2001-107752 4/2001
JP 2001-260986 9/2001
JP 2003-098044 4/2003
JP 2003-127986 5/2003
JP 2003-146293 5/2003
JP 2004-036574 2/2004
JP 2004-068704 3/2004
JP 2004-208452 7/2004
JP 2004-244003 9/2004
JP 2004-286018 10/2004
JP 2005-161906 6/2005
JP 2005-272352 9/2005
JP 2005-297785 10/2005
JP 2006-068575 3/2006
JP 2006-074794 3/2006
JP 2006-076871 3/2006
JP 2006-087325 4/2006
JP 2006-115305 4/2006
JP 2006-118039 5/2006
JP 2006-154480 6/2006
JP 2006-156526 6/2006

WO WO 2005/102833 * 11/2005

OTHER PUBLICATIONS

Co-pending U.S. Appl. No. 11/686,134, filed Mar. 14, 2007.
Product catalog of i6000TEC—Triple Engine Electronic Shift & throttle of Teleflex Morse Co., Ltd. (USA).
U.S. Appl. No. 11/731,691, filed Mar. 30, 2007, entitled Remote Control System for a Watercraft.
U.S. Appl. No. 11/731,057, filed Mar. 30, 2007, entitled Remote Control Unit for a Boat.
U.S. Appl. No. 11/731,422, filed Mar. 30, 2007, entitled Remote Control System for a Boat.
U.S. Appl. No. 11/731,086, filed Mar. 30, 2007, entitled Remote Control Device for a Boat.
U.S. Appl. No. 11/731,681, filed Mar. 30, 2007, entitled Remote Control Appratus for a Boat.
U.S. Appl. No. 11/688,818, filed Mar. 20, 2007, entitled Remote Control Device and Watercraft.
Barron, Jim. "Get on the Bus." Trailer Boats Magazine, Jun. 2000, p. 36.
Spisak, Larry. "Know it by Chart." Boating Magazine, May 2000, p. 100.
J.D. "Gains in technology will alter makeup of the . . . " Boating Industry International, Nov. 2000.
Declaration of Daniel J. Carr.
Denn, James. "Future boats sales will hinge on technology." Boating Industry International, Nov. 2000.
Hemmel, Jeff. "Information, Please—The digital boating revolution begins." Boating Magazine, Sep. 2000.
Kelly, Chris. "Can We Talk?" Power & Motoryacht Magazine, Jun. 2000, pp. 36 & 38, 39.
"Plug and Play" Advertisement from "Motorboating", Dec. 2000, p. 57.
"MagicBus™ i3000 Series Intelligent Steering" Instruction Manual. Telefex, Inc.
International Standard, ISO 11783-5, First Edition May 1, 2001; *Tractors and Machinery for Agriculture and Forestry-Serial Control and Communications Data Network—Part 5: Network Management*.
NMEA 2000; Standard for Serial Data Networking of Marine Electronic Devices; Main Document: Version 1.000, Sep. 12, 2001; @NMEA 1999, 2000, 2001.
NMEA 2000; Standard for Serial Data Networking of Marine Electronic Devices; Appendix A: Version 1.000, Sep. 12, 2001; @NMEA 1999, 2000, 2001.
NMEA 2000; Standard for Serial Data Networking of Marine Electronic Devices; Appendix B: @NMEA 1999, 2000, 2001.
NMEA 2000; Standard for Serial Data Networking of Marine Electronic Devices; Appendix C: Version 1.000, Sep. 12, 2001; @NMEA 1999, 2000, 2001.
NMEA 2000; Standard for Serial Data Networking of Marine Electronic Devices; Appendix D: Version 1.000, Sep. 12, 2001; @NMEA 1999, 2000, 2001.
NMEA 2000; Standard for Serial Data Networking of Marine Electronic Devices; Appendix E: ISO 11783-5 Network Management.
NMEA 2000; Standard for Serial Data Networking of Marine Electronic Devices; Appendix F: ISO 11783-5 DataLink Layer.
NMEA 2000; Standard for Serial Data Networking of Marine Electronic Devices; Appendix G: ISO 11898 Controller Area Network.

* cited by examiner

| Signal 1 | Signal 2 | Signal 3 | ECU function |
|---|---|---|---|
| 1 | 0 | 0 | Main, for left outboard motor |
| 0 | 1 | 0 | Main, for central outboard motor |
| 0 | 0 | 1 | Main, for right outboard motor |
| 0 | 1 | 1 | Auxiliary, for left outboard motor |
| 1 | 0 | 1 | Auxiliary, for central outboard motor |
| 1 | 1 | 0 | Auxiliary, for right outboard motor |

*Figure 5*

REMOTE CONTROL DEVICE, REMOTE CONTROL DEVICE SIDE ECU AND WATERCRAFT

PRIORITY INFORMATION

This application is based on and claims priority under 35 U.S.C. §119 to Japanese Patent Application No. 2006-074794, filed on Mar. 17, 2006, the entire contents of which is hereby expressly incorporated by reference herein.

BACKGROUND OF THE INVENTIONS

1. Field of the Inventions

The present inventions relate to remote control devices for electrically controlling watercraft propulsion, to remote control device side ECUs disposed on remote control devices, and to watercrafts having remote control devices.

2. Description of the Related Art

A known watercraft is disclosed in Japanese Patent Document JP-A-2005-297785, which describes a watercraft that includes a remote control device having a shift lever for remotely controlling forward, neutral and reverse mode shift operations. The watercraft propulsion device includes a gear shift unit for shifting between forward, neutral and reverse modes and an actuator for driving the gear shift unit. A control device controls an operational amount of the actuator based upon a manipulation amount of the shift lever that is manipulated within a preset range from a neutral position, the control device controlling the operational amount of the actuator so as to make it different relative to a unit manipulation amount of the shift lever within the shift range.

SUMMARY OF THE INVENTION

An aspect of at least one of the embodiments disclosed herein includes the realization that in a conventional watercraft, such as that noted above, having a plurality of cockpits and/or a plurality of outboard motors, or other watercraft propulsion devices, a plurality of remote control device side ECUs are necessary for the respective cockpits and/or for controlling the respective outboard motors. Because the respective remote control device side ECUs have different roles in this situation, several remote control device side ECUs having functions (constituents) differing from each other are required. Thus, management and maintenance of the remote control device side ECUs are complicated due to the multiplicity of differing functions (constituents) among the several remote control device side ECUs.

Thus, in accordance with at least one of the embodiments disclosed herein, a remote control device for controlling a watercraft propulsion device having at least one engine that generates propulsive power can comprise a plurality of remote control device side ECUs, each remote control device side ECU having an ECU discriminating terminal section. An ECU determining section can be configured to determine a role of the respective remote control device side ECU based upon a signal provided from the ECU discriminating terminal section. Additionally, an exclusive use section can be configured to operate based upon a signal provided from the ECU determining section to execute a function corresponding to the role that is specifically assigned.

In accordance with at least one of the embodiments disclosed herein, a remote control device side ECU can comprise an ECU discriminating terminal section, an ECU determining section can be configured to determine a role of the remote control device side ECU based upon a signal provided from the ECU discriminating terminal section. Additionally, an exclusive use section can be configured to operate based upon a signal provided from the ECU determining section to execute a function corresponding to the role that is specifically assigned.

In accordance with at least one of the embodiments disclosed herein, a remote control device for controlling a watercraft propulsion device can comprise a plurality of remote control device side ECUs having substantially the same construction, each remote control device side ECU being capable of performing multiple roles and having means for determining which of the roles is to be performed by that remote control device side ECU.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures:

FIG. 5 is a table showing exemplary signals and ECU functions according to an embodiment.

DETAILED DESCRIPTION OF THE PREFERRED EMBODIMENTS

Figure 1:
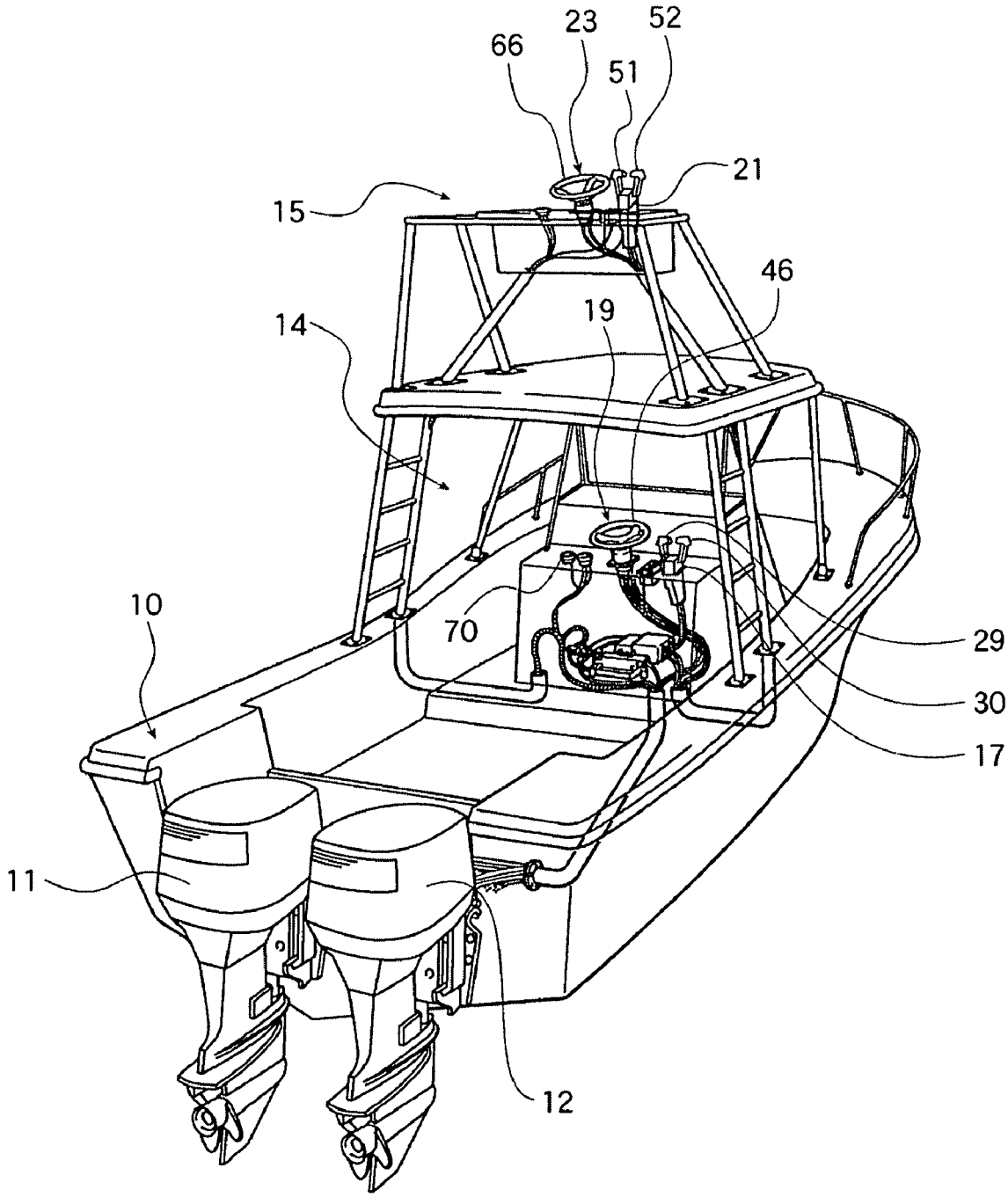
FIG. 1 is a perspective view of a watercraft according to an embodiment.

FIG. 1 is a top, rear, right side perspective view of a watercraft including a remote control system for controlling a plurality of outboard motors. The embodiments disclosed herein are described in the context of a marine propulsion system of a watercraft because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

The watercraft can include two outboard motors 11, 12 functioning as a "watercraft propulsion device" mounted to a stem of a hull 10 of the watercraft, as shown in FIG. 1. The watercraft hull 10 can have two cockpits, for example, a main cockpit 14 and an auxiliary cockpit 15.

The main cockpit 14 can have a main cockpit side remote control device 17, a key switch device 18, and a steering wheel unit 19. The auxiliary cockpit 15 can have an auxiliary cockpit side remote control device 21, a key switch device 22, and a steering wheel unit 23. The outboard motors 11, 12 can be controlled with those devices and units. Additionally, the cockpits 14, 15, can have other devices.

Figure 2:
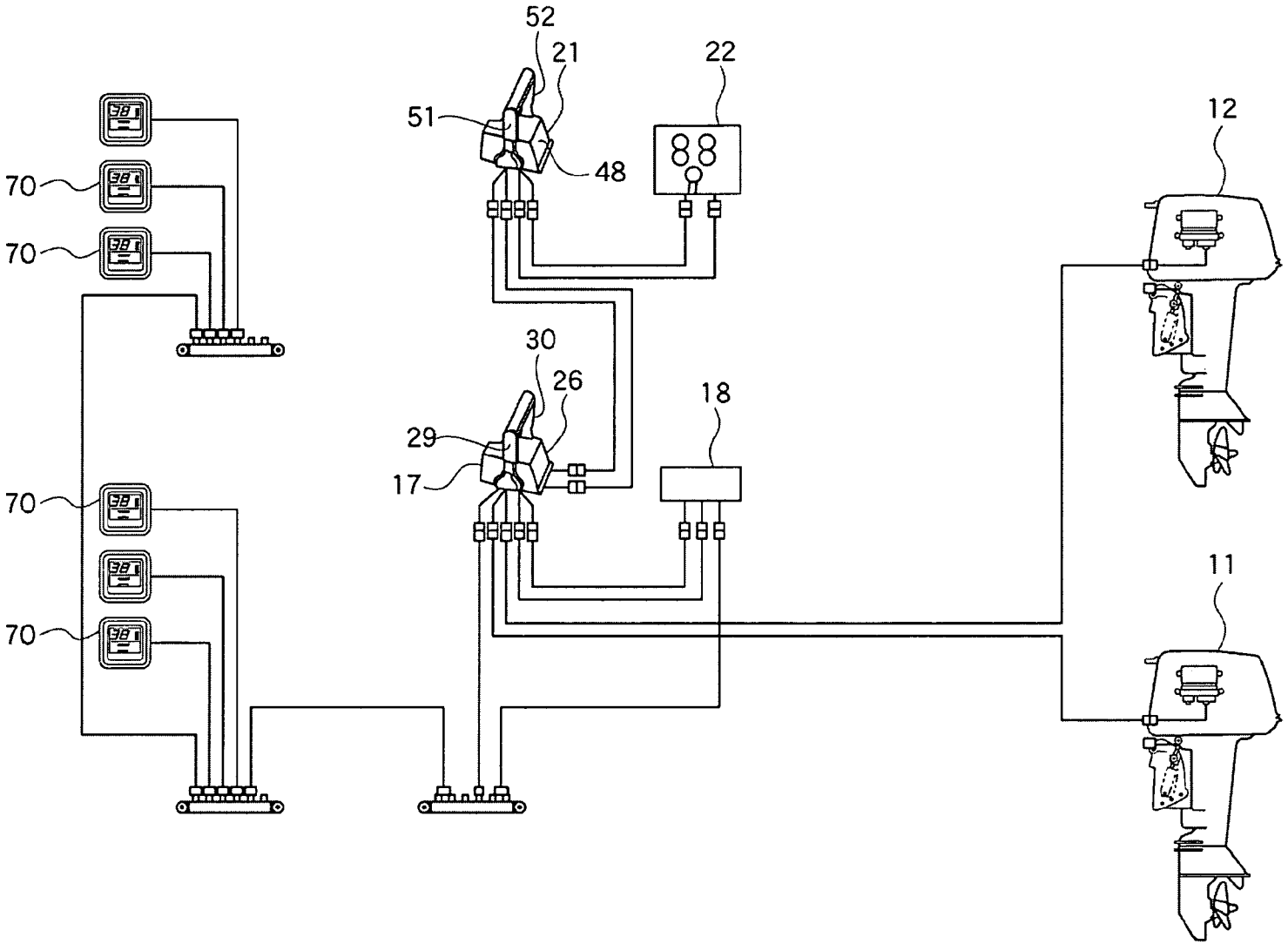
FIG. 2 is a schematic block diagram showing connections that can be made among remote control devices, outboard motors and other components in the watercraft.
Figure 3:
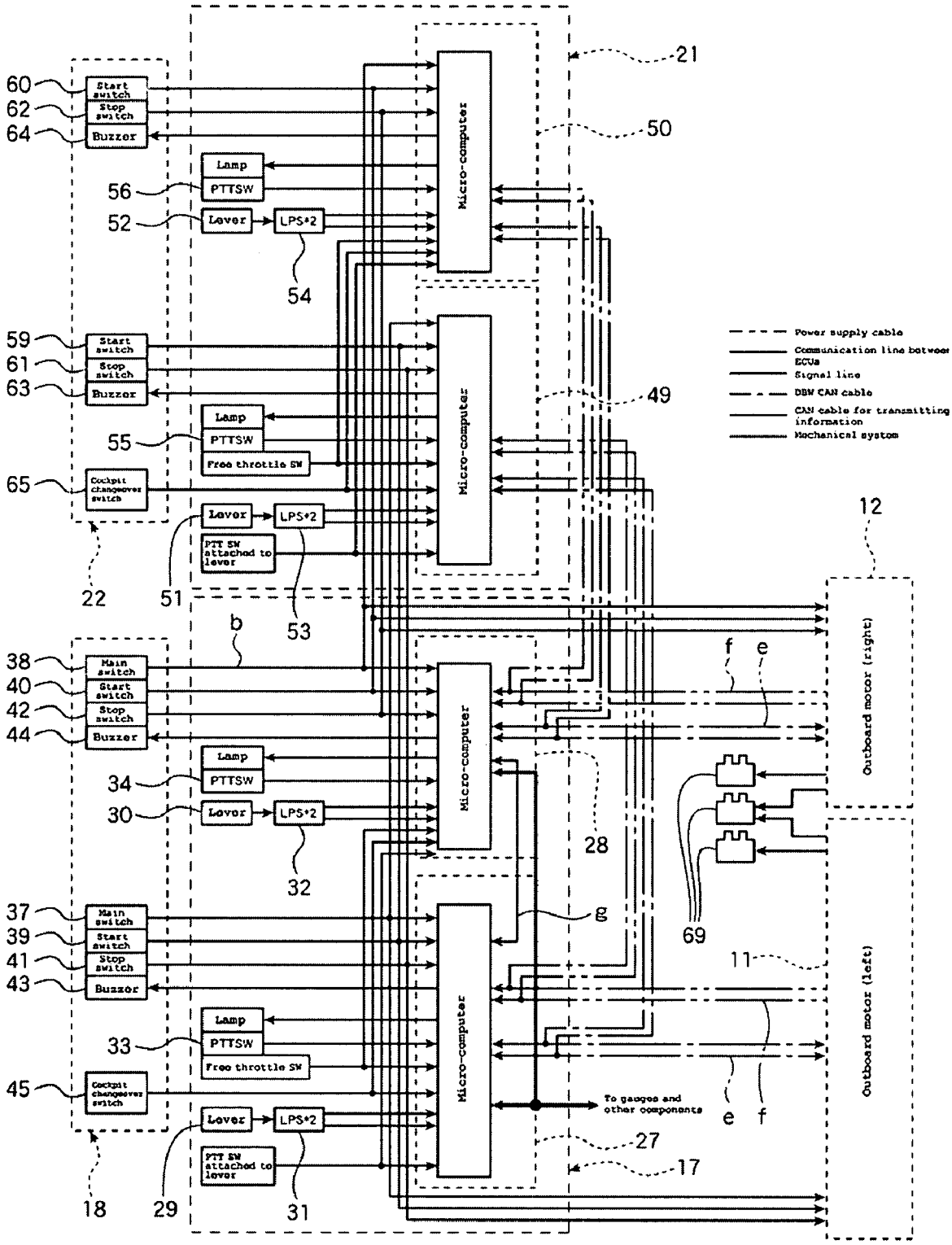
FIG. 3 is a block diagram showing connections that can be made among the remote control devices, key switches, outboard motors and other components in the watercraft.

As shown in FIGS. 2 and 3, the main cockpit side remote control device 17 of the main cockpit 14 can have a left unit controlling main remote control device side ECU 27 configured to control the outboard motor 11 positioned on the left side and a right unit controlling main remote control device side ECU 28 configured to control the outboard motor 12 positioned on the right side, both of which can be built in a remote control device body 26. Also, the remote control device 17 can have, corresponding to the outboard motors 11, 12, a pair of remote control levers 29, 30 each configured to manipulate a throttle unit and a shift unit. Additionally, the remote control device 17 can have position sensors 31, 32 configured to detect positions of the respective control levers 29, 30. The respective position sensors 31, 32 can be connected to the respective remote control device side ECUs 27, 28 through two signal lines b provided for each combination. Also, PTT (power trim and tilt) switches 33, 34 can be connected to the respective remote control device side ECUs 27, 28 through signal lines b.

The key switch device 18 can be connected to the left and right unit controlling main remote control device side ECUs 27, 28. The key switch device 18 can have two sets of components, including main switches 37, 38, starting switches 39, 40, stop switches 41, 42 and buzzers 43, 44 corresponding to the respective main remote control device side ECU 27, 28 and/or other devices. The key switch device 18 can be connected to the respective main remote control device side ECUs 27, 28 through signal lines b.

The steering wheel unit 19 of the main cockpit 14 can have a steering wheel unit side ECU which can be built in, although not shown, and can have a steering wheel 46 configured to steer the watercraft. A position sensor can be configured to detect a rotational position (rotational angular position) of the steering wheel 46. The position sensor can be connected to the steering wheel unit side ECU through a signal line.

The steering wheel unit side ECU can be connected to the respective remote control device side ECUs 27, 28 through DBW CAN cables functioning as signal lines. The term DBW is an abbreviation for "Drive-By-Wire" and refers to an operating device in which electrical connections are used instead of mechanical connections. The term CAN is an abbreviation for "Controller Area Network."

As shown in FIG. 3, similarly to the structure of the main cockpit side 14 discussed above, the auxiliary cockpit side remote control device 21 of the auxiliary cockpit 15 can have a left unit controlling auxiliary remote control device side ECU 49 configured to control the outboard motor 11 positioned on the left side and a right unit controlling auxiliary remote control device side ECU 50 configured to control the outboard motor 12 positioned on the right side, both of which can be built in a remote control device body 48. Also, the remote control device 21 can have, corresponding to the outboard motors 11, 12, a pair of remote control levers 51, 52 (FIG. 2) each configured to manipulate a throttle unit and a shift unit. The device 21 can also have position sensors 53, 54 configured to detect positions of the respective control levers 51, 52. The respective position sensors 51, 52 can be connected to the respective remote control device side ECUs 49, 50 through two signal lines b provided for each combination. Also, PTT (power trim and tilt) switches 55, 56 can be connected to the respective remote control device side ECUs 49, 50 through signal lines b.

The key switch device 22 (FIG. 2) can be connected to the left and right unit controlling auxiliary remote control device side ECUs 49, 50. The key switch device 22 can have two sets of components, including start switches 59, 60, stop switches 61, 62 and buzzers 63, 64 corresponding to the respective auxiliary remote control device side ECU 49, 50 and/or other devices. The key switch device 22 can be connected to the respective auxiliary remote control device side ECUs 49, 50 through signal lines b.

The steering wheel unit 23 of the auxiliary cockpit 15 can have a steering wheel unit side ECU which can be built in, although not shown, and can have a steering wheel 66 configured to steer the watercraft. A position sensor can be configured to detect a position of the steering wheel 66. The position sensor can be connected to the steering wheel unit side ECU through a signal line.

The left unit controlling main remote control device side ECU 27 can be connected to an engine side ECU, which is not shown, disposed on the left outboard motor 11 through power supply cables f and DBW CAN cables e. The right unit controlling main remote control device side ECU 28 can be connected to an engine side ECU, which is not shown, disposed on the right outboard motor 12 through power supply cables f and DBW CAN cables e. Three batteries 69 can be connected to the outboard motors 11, 12. The batteries 69 can be connected to the left unit controlling main remote control device side ECU 27 and the right unit controlling main remote control device side ECU 28 through the power supply cables f.

Each engine side ECU can properly control engine operational conditions including a fuel injection amount, an injection time and an ignition time based upon a throttle valve opening provided from a throttle valve opening sensor, an engine speed provided from a crankshaft angle sensor and inputs provided from other sensors and optionally other operational conditions.

Various inputs (operational information) including the throttle valve opening and the engine speed and optionally other operational information can be transmitted from the respective engine side ECUs to the corresponding main remote control device side ECUs 27, 28 through the DBW CAN cables e. Pieces of the operational information can be transmitted and received between the respective main remote control device side ECUs 27, 28 through ECU communication lines g.

The engine side ECUs of the respective outboard motors 11, 12 can be controlled based upon the control signals provided from the respective main remote control side ECUs 27, 28. That is, the fuel injection amount, the injection time, the ignition time, etc. can be controlled so that a difference between the engine speeds of the respective outboard motors 11, 12 falls within a target amount.

The respective auxiliary remote control device side ECUs 49, 50 can be connected to the respective main remote control device side ECUs 27, 28. For example, the left unit auxiliary remote control device side ECU 49 can be connected to the left unit main remote control device side ECU 27 through the DBW CAN cables e and the power supply cables f, while the right unit auxiliary remote control device side ECU 50 can be connected to the right unit main remote control device side ECU 28 through the DBW CAN cables e and the power supply cables f.

Additionally, gauges 70, shown in FIG. 2, can be used in some embodiments.

The remote control device side ECUs 27, 28, 49, 50 can be positioned at multiple cockpits and can control multiple outboard motors. The respective control device side ECUs 27, 28, 49, 50 can have the same construction. That is, each remote control device side ECU 27, 28, 49, 50 can have a common program section 71, such as that shown in FIG. 4. The common program section 71 can include a first exclusive use section 72 configured to execute a function corresponding to a specific role for the main cockpit 14 and for the left outboard motor 11 and optionally a second exclusive use section 73 configured to execute a function corresponding to a specific role for the main cockpit 14 and for another propulsion unit, such as a central outboard motor. The common program section 71 can also include other exclusive use sections, such as a third exclusive use section 74 configured to execute a function corresponding to a specific role for the main cockpit 14 and for the right outboard motor 12, a fourth exclusive use section 75 configured to execute a function corresponding to a specific role for the auxiliary cockpit 15 and for the left outboard motor 11, a fifth exclusive use section 76 configured to execute a function corresponding to a specific role for the auxiliary cockpit 15 and for the central outboard motor, and a sixth exclusive use section 77 configured to execute a function corresponding to a specific role for the auxiliary cockpit 15 and for the right outboard motor 12. While a central outboard motor is not illustrated in FIGS. 1-3, a central outboard motor and/or other additional discrete propulsion units can be provided in some embodiments, as discussed below.

Figure 4:
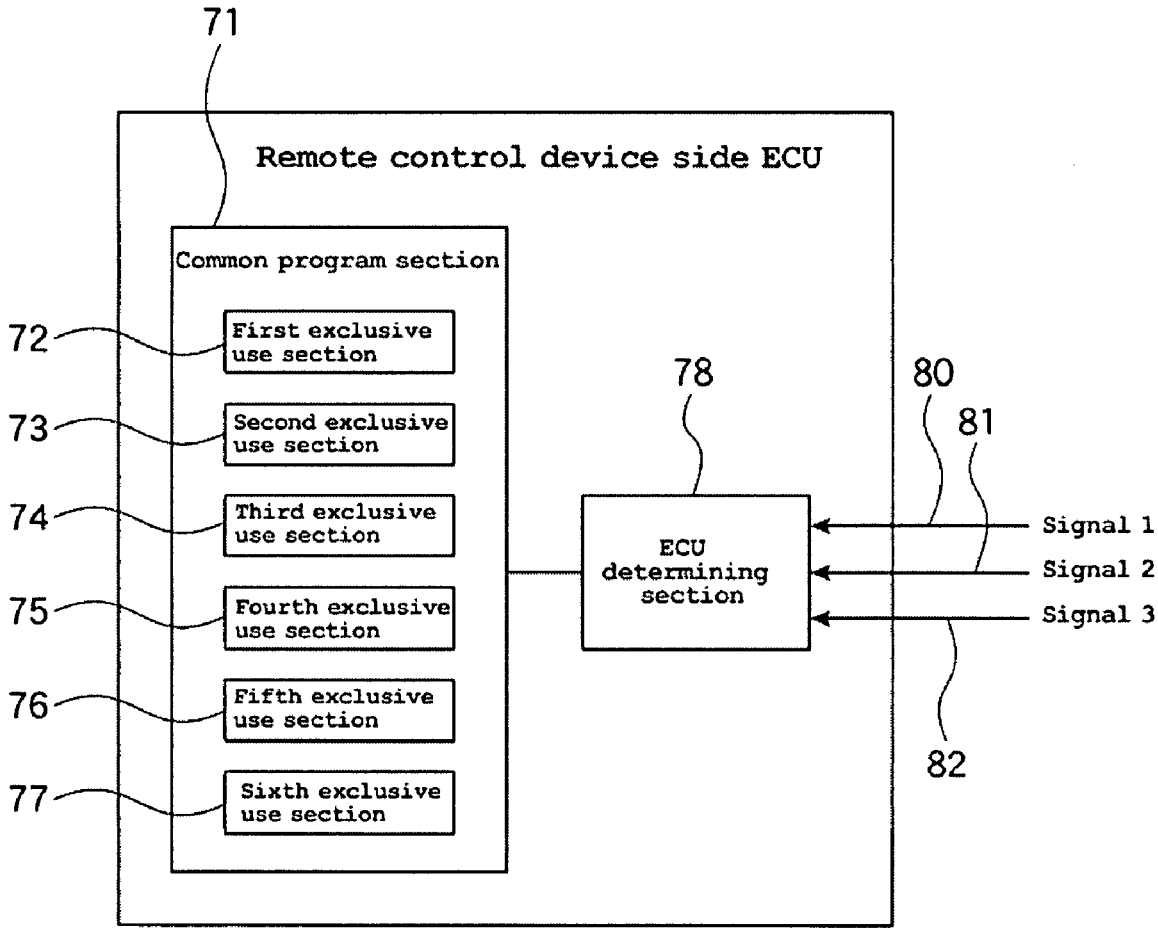
FIG. 4 is a block diagram showing a remote control device side ECU according to an embodiment.

As shown in FIG. 4, the respective exclusive use sections 72-77 can be connected to an ECU determining section 78. The exclusive use sections 72-77 can be selectively operated in response to specific signals provided from the ECU determining section 78.

Three ECU discriminating terminal sections 80, 81, 82 can be connected to the ECU determining section 78. Based upon signals provided through the ECU discriminating terminal sections 80, 81, 82, the ECU determining section 78 can be configured to determine which role is to be executed by the remote control device side ECU 27, 28, 49, 50 that has the particular ECU determining section 78.

The determination can be made in any manner. In some embodiments, each of the three ECU discriminating terminal sections 80, 81, 82, in each of the remote control device side ECUs 27, 28, 49, 50, can be grounded or can be connected to the power supply cable f so that each remote control device side ECU 27, 28, 49, 50 can be in a different state from each other or in the same state as each other. Signals 1, 2, 3 can be input to the ECU determining section 78 through the respective ECU discriminating terminal sections 80, 81, 82 to determine which role is assigned to the particular remote control device side ECU 27, 28, 49, 50.

For example, as shown in FIG. 5, when the value of the signal 1 provided through the first ECU discriminating terminal section 80 is "1," the value of the signal 2 provided through the second ECU discriminating terminal section 81 is "0" and the value of the signal 3 provided through the third ECU discriminating terminal section 82 is "0," it can be determined that the particular ECU is to be the remote control device side ECU 27 that can be assigned with the role for the left outboard motor 11 and for the main cockpit 14.

Also, when the signal 1 provided through the first ECU discriminating terminal section 80 is "1," the signal 2 provided through the second ECU discriminating terminal section 81 is "1" and the signal 3 provided through the third ECU discriminating terminal section 82 is "0," it can be determined that the particular ECU is to be the auxiliary remote control device side ECU 50 that can be assigned with the role for the right outboard motor 12 and for the auxiliary cockpit 15.

The roles for the other exclusive remote control device side ECUs 28, 49 can be determined in a similar manner. In an embodiment including only two outboard motors, the ECU discriminating terminal sections 80, 81, 82 can be grounded or can be connected to the power supply cable f so that there is no remote control device side ECU corresponding to the central outboard motor.

Since the respective remote control device side ECUs 27, 28, 49, 50 can have the same construction, as discussed above, management and maintenance of the remote control device side ECUs can be simplified by using fewer different types of remote control device side ECUs.

Advantageously, the respective remote control device side ECUs 27, 28, 49, 50 can be discriminated from each other by simple circuit construction because the ECU determining section 78 can determine the role of the remote control device side ECUs 27, 28, 49, 50 based upon whether the multiple ECU discriminating terminal sections 80, 81, 82 are grounded or connected to the batteries 69. With regard to any of the above described values of the discriminating terminal sections 80, 81, 82, such control can be achieved using jumpers, DIP switches, or any other switch or device.

Furthermore, because the ECU determining section 78 can determine the role of the remote control device side ECUs 27, 28, 49, 50 based upon the combinations of multiple signals inputted through the multiple ECU discriminating terminal sections 80, 81, 82, a number of types of roles of remote control device side ECUs 27, 28, 49, 50 can be discriminated using a smaller number of the ECU discriminating terminal sections 80, 81, 82. For example, six types of roles can be discriminated based on three input signals, as discussed above.

Thus, even in a watercraft having a plurality of propulsion devices and remote control device side ECUs corresponding to the plurality of the propulsion devices, the respective remote control device side ECUs can be easily discriminated. Similarly, the remote control device side ECUs can be easily discriminated in a watercraft having a plurality of cockpits and a respective remote control device side ECU in each cockpit.

When the respective ECU determining sections 78 determine the roles of the remote control device side ECUs 27, 28, 49, 50, the specific exclusive use sections 72-77 can operate so that the respective remote control device side ECUs 27, 28, 49, 50 execute different functions, some optional functions being described below.

For example, in some situations, the engines of different propulsion units might create a pulsating sound resulting from a small difference in the speeds of the engines. This is also referred to as a "beat" sound. In acoustics, a beat refers to interference between two sounds of slightly different frequencies, perceived as periodic variations in volume whose rate is the difference between the two frequencies.

Thus, in some embodiments, for example, if the levers 29, 30 are close to being in the same position, the right unit controlling main remote control device side ECU 28 can control the engine speed of the right outboard motor 12 so that the engine speed becomes equal to that of the left outboard motor 11 to inhibit generation of beat sounds. However, other techniques can also be used.

In some embodiments, the auxiliary remote control device side ECUs 49, 50 can be configured to control the outboard motors 11, 12 via the main remote control device side ECUs 27, 28 rather than directly provide commands to the respective outboard motors 11, 12.

If the auxiliary remote control device side ECUs 49, 50 malfunction, the main remote control device side ECUs 27, 28 can be configured to provide shut-down commands to the respective auxiliary remote control device side ECUs 49, 50.

The main remote control device side ECUs 27, 28 can be configured to output signals based on operation of the main switches 37, 38 to start the auxiliary remote control device side ECUs 49, 50 and the engine side ECUs.

In some embodiments, the main remote control device side ECUs 27, 28 can be configured to transmit engine information to the gauges 70 and other components, while the auxiliary remote control device side ECUs 49, 50 do not.

Figure 6:
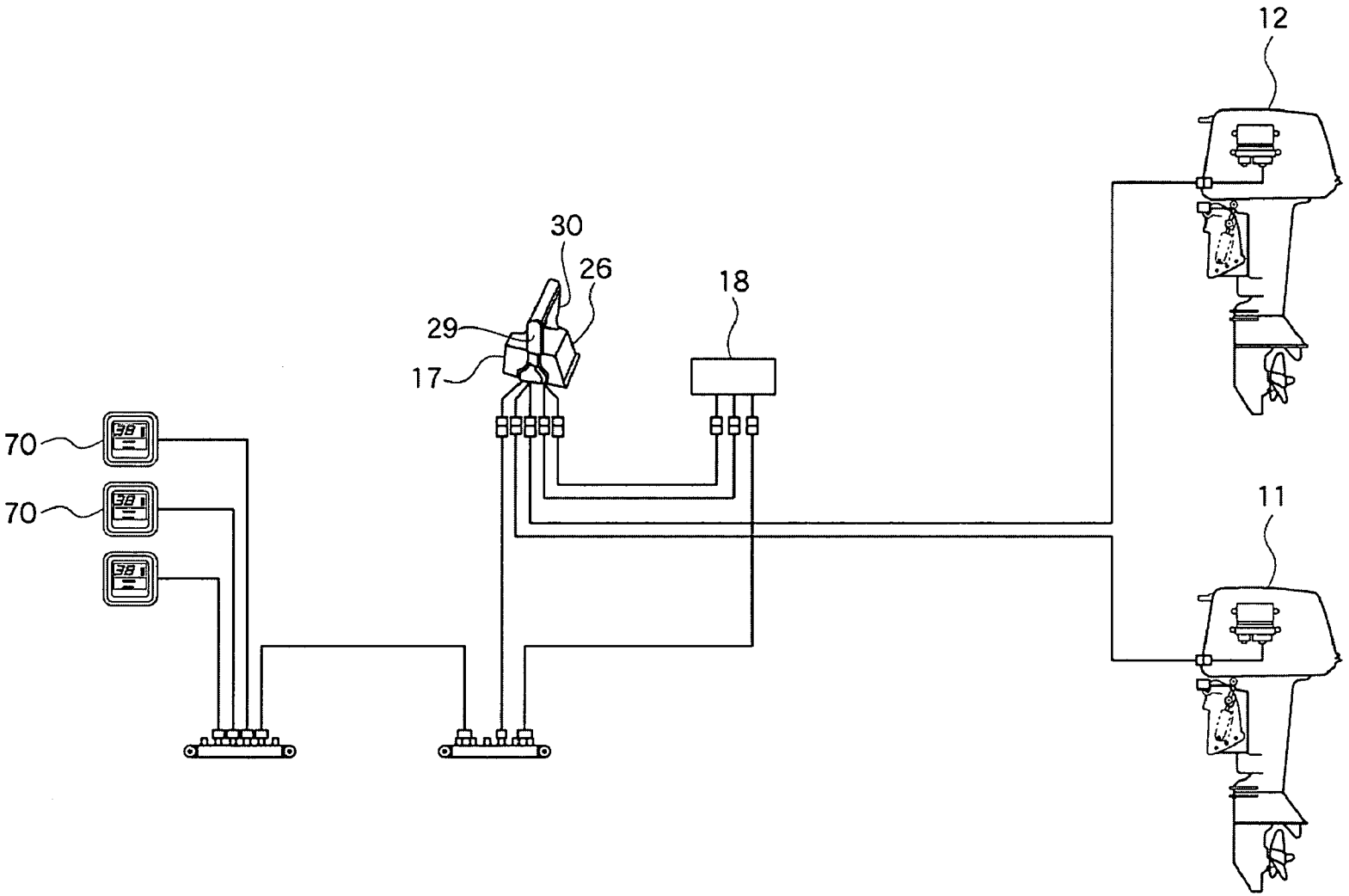
FIG. 6 is a schematic block diagram showing a watercraft having two outboard motors and one cockpit according to an embodiment.
Figure 7:
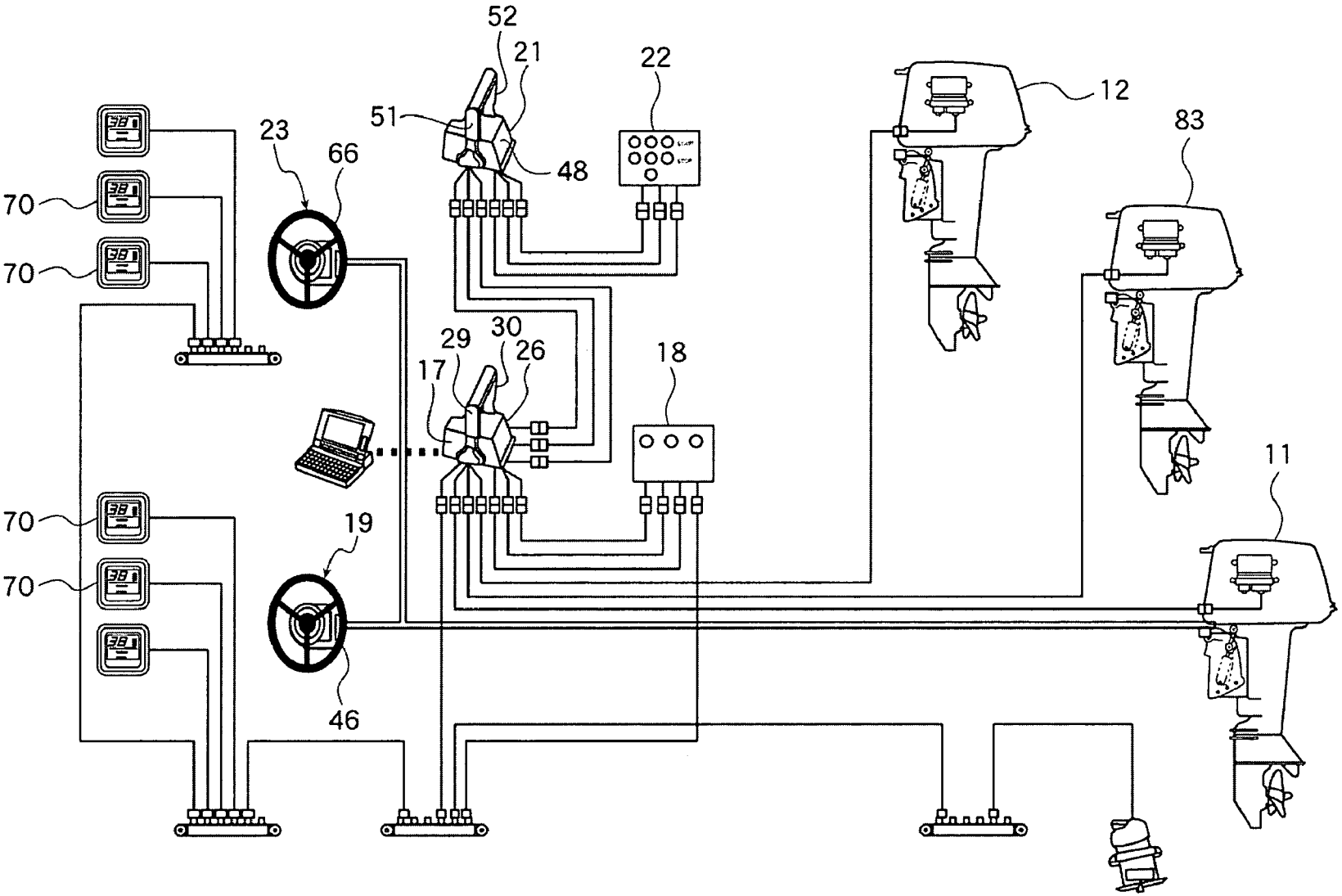
FIG. 7 is a schematic block diagram showing a watercraft having three outboard motors and two cockpits according to an embodiment.

Although the remote control device side ECUs 27, 28, 49, 50 are discussed above in the context of a watercraft having two outboard motors and two cockpits, such remote control device side ECUs can be applied in other contexts, such as, but without limitation, a watercraft having one outboard motor and one cockpit, a watercraft having two outboard motors and one cockpit as shown in FIG. 6, and a watercraft having three outboard motors and two cockpits as shown in FIG. 7. Other numbers of cockpits and propulsion units can also be used In the case of a watercraft having three outboard motors as shown in FIG. 7, a remote control device side ECU, which is not shown, can be configured to control a central outboard motor 83 including controlling the shift and throttle operations of the central outboard motor in targeting respective middle positions of the left remote control levers 29, 51 or respective middle positions of the right remote control levers 30, 52.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A remote control device for controlling a watercraft propulsion system having at least one of a plurality of cockpits and a plurality of propulsion devices each of which have an engine that generates propulsive power, the remote control device comprising a plurality of remote control device side ECUs, each remote control device side ECU having an ECU discriminating terminal section, an ECU determining section configured to determine a role of the respective remote control device side ECU based upon a signal provided from the ECU discriminating terminal section, and a plurality of exclusive use sections, each exclusive use section defining a role defined by a different combination of propulsion device mounting positions and cockpit priority, and each exclusive use section being configured to operate based upon a signal provided from the ECU determining section to execute a function corresponding to the role that is specifically assigned, wherein the plurality exclusive use sections include at least first, second, third, and fourth exclusive use sections, the first exclusive use section defining role as a main remote control for a propulsion unit positioned on a right side of the watercraft, the second exclusive use section defining a role as a main remote control for a propulsion unit positioned on a left side of the watercraft, the third exclusive use section defining a role as an auxiliary remote control for a propulsion unit positioned on a right side of the watercraft, the fourth exclusive use section defining a role as an auxiliary remote control for a propulsion unit positioned on a left side of the watercraft.

2. The remote control device of claim 1, wherein each remote control device side ECU has a plurality of the ECU discriminating terminal sections, each ECU discriminating terminal section being connected to or disconnected from a power source or a ground such that connecting conditions of the respective ECU discriminating sections of each remote control device side ECU differ from connecting conditions of every other remote control device side ECU, whereby the ECU determining section determines the role of the particular remote control device side ECU based upon the connecting conditions.

3. The remote control device of claim 2, wherein the ECU determining sections determine the role of the respective remote control device side ECUs based upon combinations of a plurality of signals which differ from each other and which are provided from the plurality of the ECU discriminating terminal sections.

4. The remote control device of claim 2, wherein the plurality of remote control device side ECUs correspond to a plurality of the propulsion devices.

5. The remote control device of claim 4, configured to control a watercraft having a plurality of cockpits, each cockpit having a respective remote control device side ECU.

6. The remote control device of claim 2, configured to control a watercraft having a plurality of cockpits, each cockpit having a respective remote control device side ECU.

7. The remote control device of claim 1, wherein the plurality of remote control device side ECUs correspond to a plurality of the propulsion devices.

8. The remote control device of claim 7, configured to control a watercraft having a plurality of cockpits, each cockpit having a respective remote control device side ECU.

9. The remote control device of claim 1, configured to control a watercraft having a plurality of cockpits, each cockpit having a respective remote control device side ECU.

10. The remote control device of claim 9, in combination with a watercraft.

11. The remote control device of claim 1, wherein all of the plurality of remote control device side ECUs have the same construction.

12. The remote control device of claim 1, in combination with a watercraft.

13. The remote control device of claim 1, wherein each exclusive use section defines a different role defined by a unique combination of propulsion device positions and cockpit priority, wherein cockpit priority is defined as either a main cockpit or an auxiliary cockpit.

14. A remote control device side ECU, comprising an ECU discriminating terminal section, an ECU determining section configured to determine a role of the remote control device side ECU based upon a signal provided from the ECU discriminating terminal section, and a plurality of exclusive use sections, each corresponding to a different role defined by a different combination of propulsion device mounting position and cockpit priority, and each of the plurality of exclusive use sections being configured to operate based upon a signal provided from the ECU determining section to execute a function corresponding to the role that is specifically assigned, wherein the plurality exclusive use sections include at least first, second, third, and fourth exclusive use sections, the first exclusive use section defining a role as a main remote control for a propulsion unit positioned on a right side of the watercraft, the second exclusive use section defining a role as a main remote control for a propulsion unit positioned on a left side of the watercraft, the third exclusive use section defining a role as an auxiliary remote control for a propulsion unit positioned on a right side of the watercraft, the fourth exclusive use section defining a role as an auxiliary remote control for a propulsion unit positioned on a left side of the watercraft.

15. A remote control device for controlling a watercraft propulsion device, comprising a plurality of remote control device side ECUs having substantially the same construction, each remote control device side ECU being capable of performing multiple roles, each of the roles being defined by a different combination of propulsion device mounting position and cockpit priority, and having means for determining which of the roles is to be performed by that remote control device side ECU, the remote control side ECUs are configured to perform at least first, second, third, and fourth roles, the first role being defined as a main remote control for a propulsion unit positioned on a right side of the watercraft, the second role being defined as a main remote control for a propulsion unit positioned on a left side of the watercraft, the third role being defined as an auxiliary remote control for a propulsion unit positioned on a right side of the watercraft, the fourth role being defined as an auxiliary remote control for a propulsion unit positioned on a left side of the watercraft.

16. The remote control device of claim 15, wherein the means for determining comprises an ECU discriminating terminal section and an ECU determining section configured to determine the role to be performed based upon a signal provided from the ECU discriminating terminal section and output a signal indicating the role to be performed.

17. The remote control device of claim 16, wherein the means for determining comprises a plurality of the ECU discriminating terminal sections configured to be connected to or disconnected from a power source or the ground.

18. The remote control device of claim 15, wherein each remote control device side ECU is capable of performing roles corresponding to a plurality of the propulsion devices.

19. The remote control device of claim 15, wherein each remote control device side ECU is capable of performing roles corresponding to a plurality of cockpits.

20. The remote control device of claim 15, wherein the means for determining determines the role of the remote control device side ECU based upon a combination of a plurality of signals.

21. The remote control device of claim 15, in combination with a watercraft propulsion device.

22. The remote control device of claim 15, wherein all of the plurality of remote control device side ECUs have the same construction.

* * * * *